United States Patent [19]

Yano

[11] Patent Number: 4,870,731

[45] Date of Patent: Oct. 3, 1989

[54] ROLLER FOR REMOVING OR IMPARTING SHRINKAGES ON A METAL OR CLOTH SHEETING

[75] Inventor: Akechi Yano, 2, Kirusuidori 4-chome, Moriguchishi, Osakafu, Japan

[73] Assignee: Akechi Yano, Osakafu, Japan

[21] Appl. No.: 127,624

[22] Filed: Nov. 30, 1987

Related U.S. Application Data

[63] Continuation of Ser. No. 927,864, Nov. 7, 1986, abandoned.

[30] Foreign Application Priority Data

| | | | |
|---|---|---|---|
| Nov. 13, 1985 | [JP] | Japan | 60-255584 |
| Nov. 21, 1985 | [JP] | Japan | 60-263552 |
| Mar. 7, 1986 | [JP] | Japan | 61-51092 |

[51] Int. Cl.[4] ..... B21B 27/00

[52] U.S. Cl. ..... 29/116.1; 29/122; 29/123; 29/125

[58] Field of Search ..... 29/113 AD, 116 AD, 122, 29/125, 123; 100/155 R, 155 G, 156, 160, 164, 165, 168, 176

[56] References Cited

U.S. PATENT DOCUMENTS

| | | | |
|---|---|---|---|
| 1,317,713 | 10/1919 | Linder | 29/122 |
| 1,338,178 | 4/1920 | Henderson | 29/122 |
| 2,732,591 | 1/1956 | Whittum | 29/122 |
| 3,786,975 | 1/1974 | Heymanns | 29/125 |
| 3,831,239 | 8/1974 | Hoff et al. | 29/125 |
| 3,884,623 | 5/1975 | Slack | 29/122 |
| 4,068,360 | 1/1978 | Freuler | 29/116 AD |
| 4,253,392 | 3/1981 | Brandon et al. | 29/122 |
| 4,311,509 | 1/1982 | Reader et al. | 29/125 |
| 4,376,643 | 3/1983 | Kahle et al. | 29/125 |
| 4,414,890 | 11/1983 | Schiel et al. | 29/116 AD |
| 4,502,312 | 3/1985 | Marchioro | 29/113 AD |

*Primary Examiner*—Howard N. Goldberg
*Assistant Examiner*—Irene Cuda
*Attorney, Agent, or Firm*—Barnes & Thornburg

[57] ABSTRACT

A roller comprising a roller surface layer whose diameter progressively diminishes from its central portion toward the opposite ends, and an arched roller shaft for rotatably supporting the roller surface layer, thereby ensuring that the sheeting is subjected to stretching or shrinking without the possibility of permanent set therein.

21 Claims, 7 Drawing Sheets

ROLLER FOR REMOVING OR IMPARTING SHRINKAGES ON A METAL OR CLOTH SHEETING

This is a continuation of application Ser. No. 927,864, filed Nov. 7, 1986, now abandoned.

BACKGROUND OF THE INVENTION

1. Field of the Invention

The present invention relates to a roller for removing or imparting shrinkages on a metal or cloth sheeting, and more particularly to a roller for such use, the roller having a surfacial layer whose diameter progressively diminishes from its central portion toward the opposite ends, and being supported on an arched shaft rotatively, thereby ensuring that the sheeting is stretched or shrinked without the possibility of leaving permanent deflection therein.

2. Description of the Prior Art

To remove or impart shrinkages on metal or cloth sheeting, the common practice is to use a barrel-shaped roller supported by a straight shaft. The barrel-shape roller has a cross-section of symmetrically arched profiles like a beer barrel. Such barrel-shaped rollers are useful for carrying a thin sheet thereon without the possibility of slipping. When a sheet runs on the arched surfaces of the roller the contact therebetween is minimized so as not to produce a permanent set on the sheet.

There is a case where two barrel-shaped rollers are used in pair as a pinch roller unit. When tapes of different thicknesses are passed side by side therethrough with thin tapes inside and thick tapes outside, they are fed out at a constant rate irrespective of the differences in thickness. This requires that the same number of winders having different r.p.m. as that of the tapes are used.

There is another roller unit which comprises an arched roller having a constant cross-sectional area throughout its length, which is carried on an arched shaft. When a sheet material is passed on this roller a force acts on the sheet crosswise, that is, axially of the shaft. When the sheet runs toward the peripheral edges of the roller it is subjected to an outward force, whereas when the sheet runs toward the center it is subjected to an inward force. In the former case the sheet is outwardly extended, and in the latter case it shrinks. This is effective to remove and impart shrinks on the metal sheet. However, the known arched roller must be provided with any means for keeping the sheet material on the roller, otherwise it would slip off. To this end the barrel-shaped roller is used to help the arched roller.

OBJECTS AND SUMMARY OF THE INVENTION

The present invention aims at solving the problems pointed to above, and has for its object to provide a roller capable of allowing a sheet material to run at a constant speed thereon with stability.

Another object of the present invention is to provide a roller capable of allowing a sheet material to run thereon without being liable to a permanent set.

Other objects and advantages of the present invention will become more apparent from the following description when taken in conjunction with the accompanying drawings which shows, for the purpose of illustration only, one embodiment in accordance with the present invention.

According to the present invention there is provided a roller which comprises a surfacial layer whose diameter progressively diminishes from its central portion toward the opposite ends, and an arched roller support shaft for rotatably supporting the roller surface layer.

DETAILED DESCRIPTION OF THE INVENTION

Figure 1A:
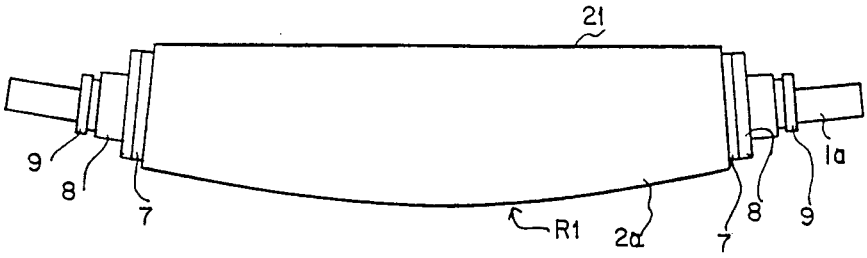
FIGS. 1A and 1B are a side view and a cross-sectional view showing a roller embodying the present invention, respectively.
Figure 1B:
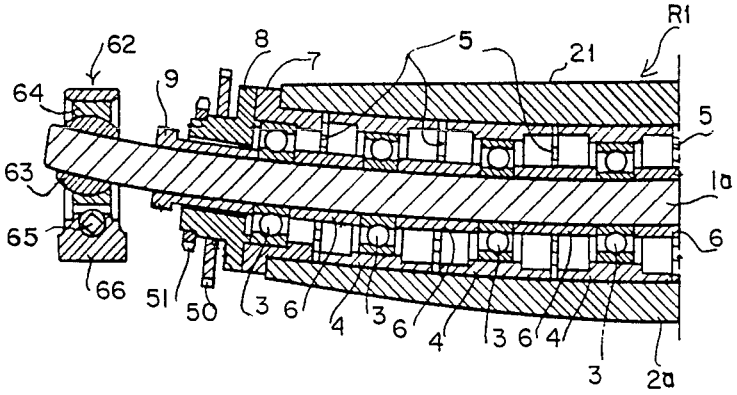

In FIG. 1 there is provided a roller R1 which includes a shaft 1*a* and a surface layer in the form of a rubber lining 2*a*, which shaft is arched as shown in FIG. 1B. The rubber lining 2*a* is rotatable with respect to the arched shaft 1*a* by means of a plurality of bearings 3, wherein the reference numeral 4 denotes a casing for housing the bearing 3. The casings 4 and the rubber lining 2*a* are fastened to each other in a known manner. The casings 4 are separated by ring-shaped partitions 5 having an equal thickness. The rubber lining 2*a* is shaped like a crown, that is, convex in the middle, which means that the diameter of the rubber lining progressively increased toward the middle portion. When the arched shaft 1*a* is supported in such a manner as to allow it to arch downward as shown in FIG. 1B, the top surface 21 of the rubber lining 2*a* becomes straignt or horizontal. When the rubber lining 2*a* is rotated with respect to the shaft 1*a* an expanding force exerts on the convex side thereof whereas a shrinking force does on the straight side thereof. The degree of expansion and shrinkage depend on the angle of rotation.

The reference numeral 6 denotes a sleeve used as a spacer between the shaft 1*a* and the bearings 3, and the numeral 7 denotes an end flange fitted in the end portion of the rubber lining 2*a*, the end flange being fixed thereto by means of a stop flange 8. The reference numeral 9 denotes a set sleeve.

Figure 2B:
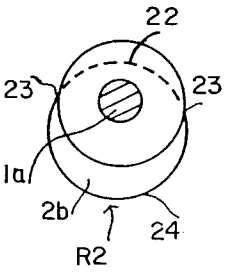
FIGS. 2A and 2B are a side view and a front view showing a modified version of the invention, respectively.
Figure 2A:
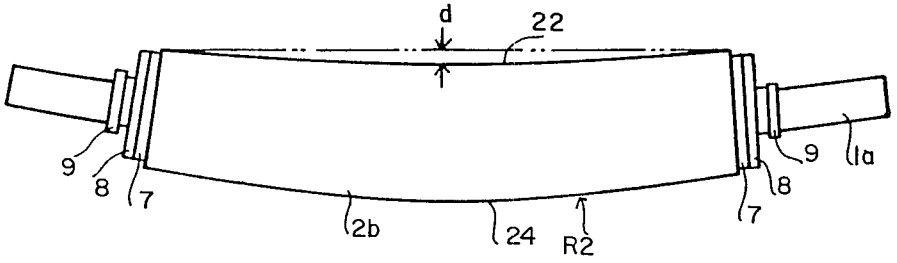

Referring to FIGS. 2A there is provided a roller R2 including a roller surface layer 2*b* which is arched as a whole unlike the roller R1 which has a straight top surface 21. The top surface 22 is concave by a distance (d) with respect to the straight surface of the roller R1, the straight surface being shown by dotted lines in FIGS. 2A. In this way this roller surface layer 2*b* has a shallowly arched surface 22 and a deeply arched surface 24 with straight sides 23 extending therebetween as shown in FIG. 2B. Herein the "deeply" and "shallowly" are to be construed as relative with respect to each other.

Figure 3:
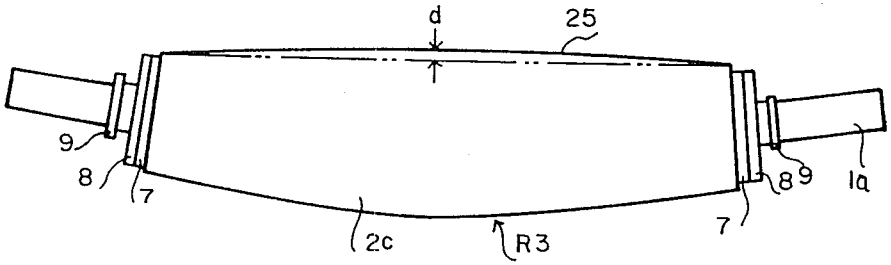
FIG. 3 is a side view showing another modified version of the invention.

FIG. 3 shows a further modified roller R3 including a roller surface layer 2c which has an upwardly arched top surface 25 although the degree of arching is smaller than that of the bottom arched surface.

The rollers R2 and R3 have the same internal structure as that of the roller R1. These rollers are made in the following manner:

A roller is prepared which has a previously thickened surfacial layer made of soft material, such as rubber, plastic, ceramic and mild steel. The roller surface layer is carried on an arched shaft, when necessary, through a core cylinder 30 or 40 shown in FIGS. 4C or 4D or any other means which enables the roller surface layer to rotate thereon. The arched shaft is fixed with its arched portion downward. Then a cutting blade is applied to the roller surface layer in rotation so as to shape the desired profile of the roller surface layer, that exhibits a top surface which is horizontal, arched, or convex. In common with all the profiles the roller surface layer is cut so that the diameter thereof diminishes progressively toward the end portions. In this way the profile of the roller is shaped as shown in FIGS. 2A, 1A or 3 as desired. The important thing is that the arched roller is fixed, with its arched portion downward in a vertical plane in which the shaft is projected from its side. The shaft is arched to the extent which allows the roller surface layer to rotate thereon. In general the curvature is 9 mm to 400 m, preferably 18 mm to 200 m, more preferably 36 mm to 100 m. There is no limitation to the length and diameter of the shaft. In general the length can be 8 mm to 20 m, preferably 12 mm to 10 m, more preferably 15 mm to 6 m, and the diameter can be 1 mm to 5 m, preferably 2 mm to 2 m, more preferably 5 mm to 1 m.

Figure 4A:
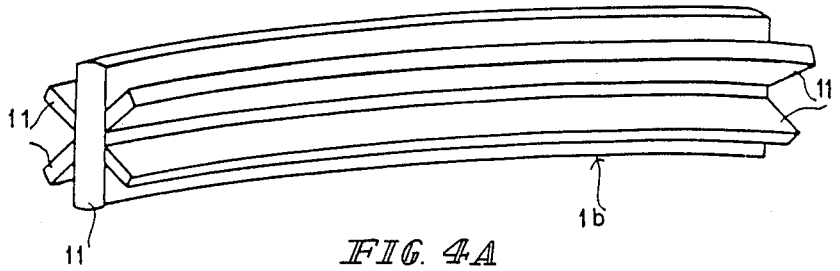
FIGS. 4A and 4B are a perspective view and an end view showing an example of a roller support shaft for supporting the roller surface layer of the invention.
Figure 4B:
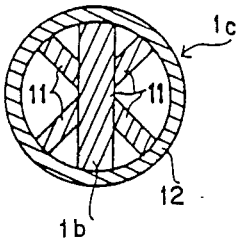

The cross-sectional shape and dimensions of the shaft are selected; round, radial (FIG. 4A) or any other forms. The shaft shown in FIG. 4A consists of several plates 11 radially arranged so as to constitute a bar 1b, and the one shown in FIG. 4B consists of the bar 1b and a cylinder 12 for housing the bar 1b. To reduce the weight, increase the strength or secure quick cooling down, various shapes of the shaft are appropriately selected.

As mentioned above, one of the features of the present invention resides in the progressively diminishing diameter of the roller toward its opposite ends, thereby enabling the sheeting to run in face-to-face contact with the roller.

Under the present invention the peripheral surfaces of the roller take one of the above-mentioned three profiles as shown in FIGS. 1A to 3, that is, one state in which one side of the roller has a larger radius of curvature than that of the opposite peripheral side (FIG. 2A), another state in which one side of the roller is straight (FIG. 1A), and a third state in which one side of the roller is concave in the middle whereas the opposite side is convex (FIG. 2A). In this specification the convex, concave arched or arching and straight mean that the shapes of the shaft and roller appear in the respective forms in a vertical plane on which they are projected from their sides.

Figure 5:
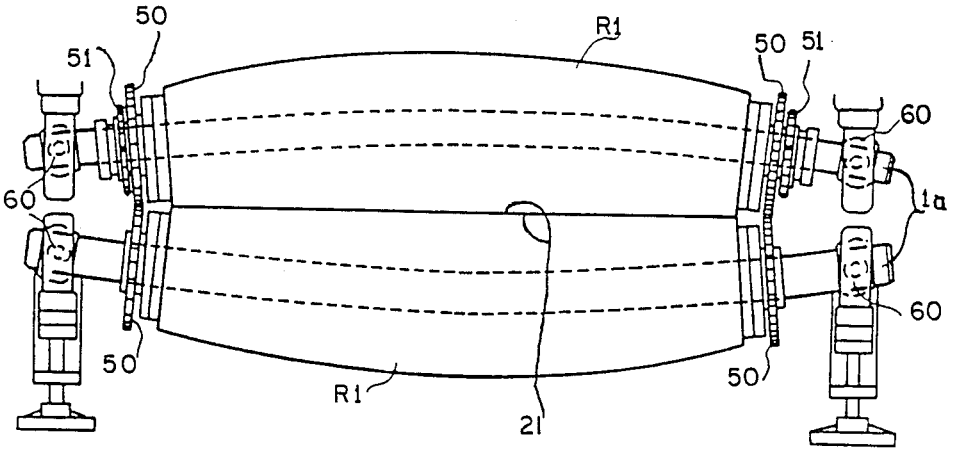
FIG. 5 is a diagrammatic side view showing a pair of rollers each embodying the present invention.

As a result of such profiles the sheeting passing on the roller is subjected to extension in width at one side and reduction at the opposite side. To multiply the effects of the roller two rollers can be used in pairs as shown in FIG. 5.

The roller surface layer is made of soft elastic material, such as rubber, Ni-Ti alloy, Cu-Zn-Al alloy, ceramic. A rubber roller surface layer is effective to prevent the sheeting from slipping thereon, and a metal or ceramic roller surface layer is advantageous in heat-proof quality and avoiding dust adhering to the sheeting. The roller surface layer can be provided with grooves or ditches on its surface to allow water to drain from the roller surface, or to prevent the sheeting from slipping on the roller.

The size of the roller is determined in accordance with the sheeting which is to be dealt with. In FIG. 2A and d is preferably 0.1 mm to 10 cm.

In the embodiment shown in FIG. 1A the shaft 1a is made of steel (55C), measuring 1620 mm long, 45 mm is diameter, and 25717.7 mm in the radius of curvature. The roller surface layer 2a is 1200 mm long, 154 mm in the diameter of its middle portion, and 120 mm in the diameters of its end portions, wherein the lining layer is 8 to 15 mm in thickness. For example the hardness of the lining rubber is 35 (shore) for a cloth sheeting, and 80 for an iron sheeting. In the arrangement shown in FIGS. 2A and 3 using the same roller support shaft as that mentioned above the d is about 0.5 mm. The bearings 3 are those available in the market.

Figure 4C:
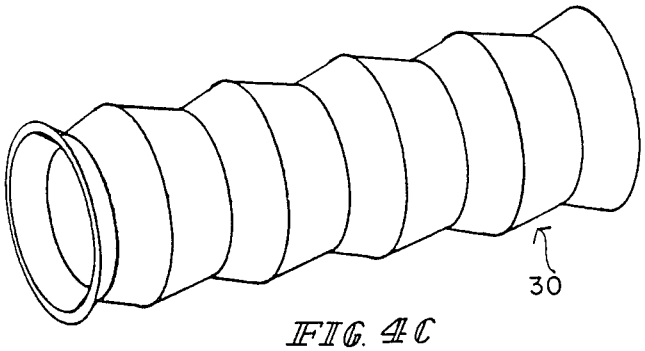
FIGS. 4C and 4D are respectively perspective views showning modified versions of the roller support shafts.
Figure 4D:
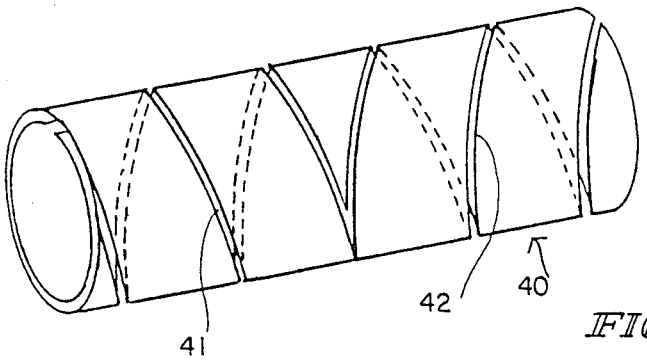

The bellows-type cylinder 30 shown in FIG. 4C whereas a cylinder 40 is shown in FIG. 4D which is provided with spiral grooves 41 and 42, wherein the groove 41 is in the clockwise direction whereas the groove 42 is in the counter-clockwise direction so that the force equally diverses in the opposite directions along the length of the cylindrical body, thereby enabling the roller to withstand a large load. This spirally grooved roller surface layer is effectively used when the roller surface layer is rotated at a high speed or when a heavy sheeting is passed thereon.

The rollers of the present invention, especially the one shown in FIG. 2A, can be used in plurality when the sheet materials are temporarily stopped thereon, or when a large load is applied to the sheeting so as to form a corrugated surface. One of the advantages of the present invention is to prevent the sheeting from undergoing a one-sided force. This avoids a permanent set in the sheeting. Under the present invention it is easy to adjust the contact between the roller and the sheeting passing thereon.

The roller shown in FIG. 1A ("straight type") is especially suitable for a pinch roller unit shown in FIG. 5, which is used when a rolled metal plate is cut to a desired length. Two rollers R1 are arranged side by side with their straight sides 21 being met. Under this arrangement the pressure by the rollers onto the sheeting is equally distributed along the length of the roller even when sheetings of various thicknesses are passed between the two rollers. The roller sends out the sheeting at various rates in accordance with the circumference of each part of the rollers. The sheeting is wound on a reel under a constant tension. Sheetings of various thicknesses are neatly wound on reels even when the reels are driven at the same speed from the same source of electricity.

In FIG. 5 there are provided gears 50 which impart the same torque equally to the rollers R1. Gears 51 are to amplify the torques acting on the rollers. The gears 51 are provided on the end portions of either of the rollers R1. The reference numeral 60 denotes a support for the shaft R1. More specifically the internal structure of the support 60 is shown in FIG. 1B. The gears 50 and 51 are fixed to the flange 8. The shafts R1 are mounted on the supports 60 through angular adjusting devices 62, which includes a ball 63 integral with the shaft 1*a*, a casing 64 rotatively accommodating the ball 63, a screw 65 adjusting the ball 63 and a housing 66.

The rollers of the present invention are used as a tenter or as a device for imparting shrinkages to the sheeting, such as cloth, metal foil or paper.

Figure 6A:
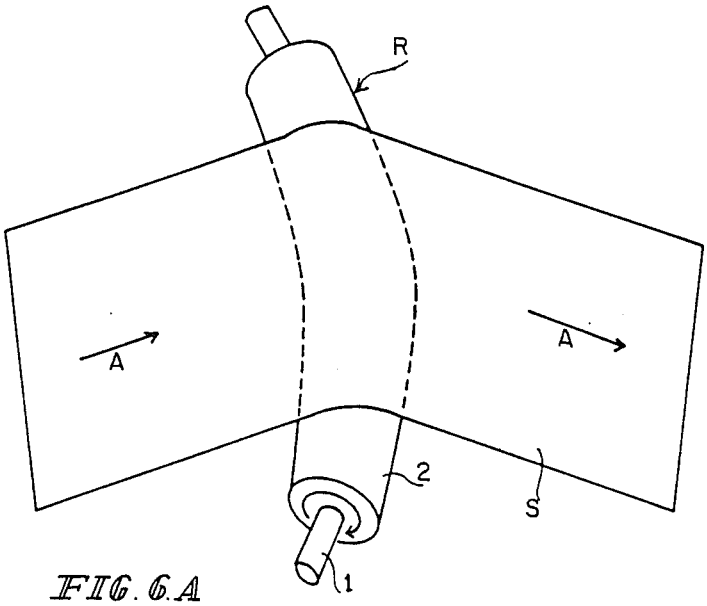
FIGS. 6A and 6B are perspective view showing the roller of the invention which is used for stretching or imparting shrinkage to a sheeting.

FIG. 6A shows a relationship between the roller (R) and the sheeting (S) when the roller is used as a tenter. The roller surface layer 2 (R) is mounted on the roller shaft in such a manner that the roller surface layer rotates from its concave side to the convex side as indicated by the arrow. The sheeting running thereon is subjected to an extending force along its width.

Figure 6B:
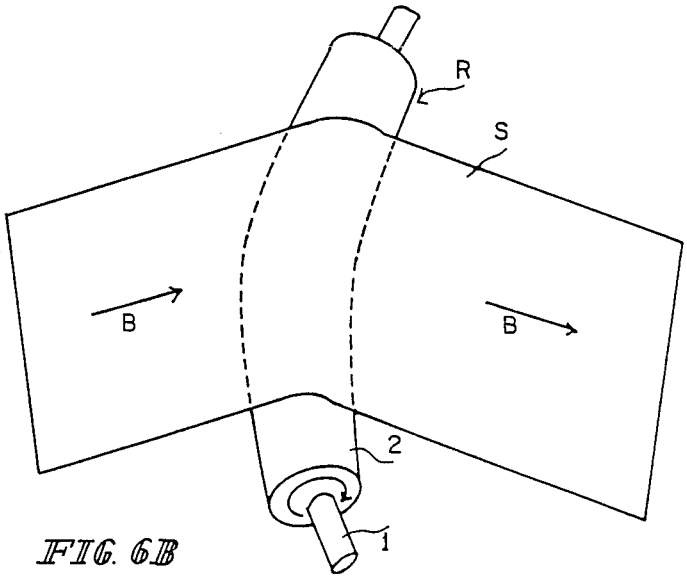

FIG. 6B shows the relationship therebetween when the roller (R) is used as a shrinking device. The roller (R) is mounted on the shaft in such a manner that it rotates from its convex side to the concave side. Under this arrangement the sheeting is subjected to an inward force while it is running on the roller (R).

In common with the examples of FIGS. 6A and 6B it is important that the sheeting is placed on the straight surface of the roller situated between the convex side and the concave side, otherwise a permanent set in would be left in the sheeting. This also secures a safe high-speed passage of the sheeting on the roller. When two rollers are used in pair as a pinch roller unit, it is more effective to prevent the sheeting from slipping on the rollers, and act stronger forces widthwise on the sheeting. When two rollers are used in pair, the types mentioned above can be selected.

Figure 7A:
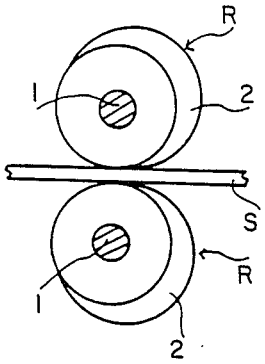
FIGS. 7A to 7F are schematic views exemplifying various phases in which paired rollers are applied to a sheeting passing therebetween.
Figure 7B:
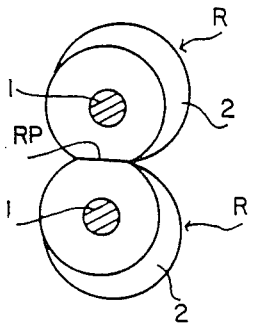

FIGS. 7A shows a state in which two rollers R are slightly spaced, whereas FIG. 7B shows a state in which the flat portions of each roller are met at RP. The latter case is advantageous in regulating the widths of the sheeting to be passed through the rollers, thereby eliminating the necessity of using an extra roller or any other means for regulating the widths of the sheeting.

Figure 7C:
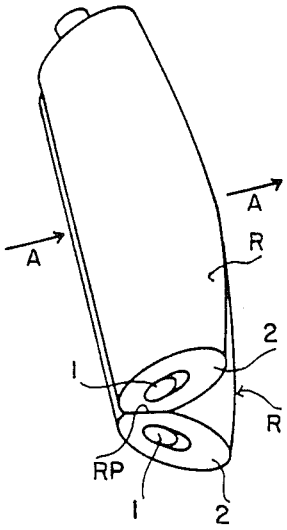
Figure 7D:
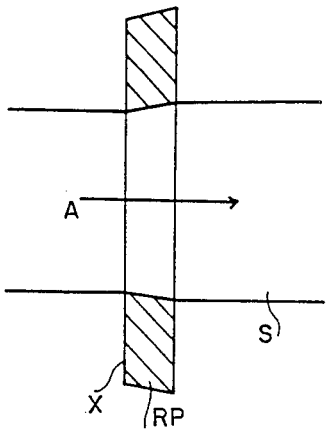

FIG. 7C shows one of the advantageous examples for stretching the sheeting. The rollers R are arranged in such a manner that the two roller surface layers are flatly met at a point near the entrance of path. Under this arrangement the sheetings is subjected to equally diverged and amplified forces as shown in FIG. 7D.

Figure 7E:
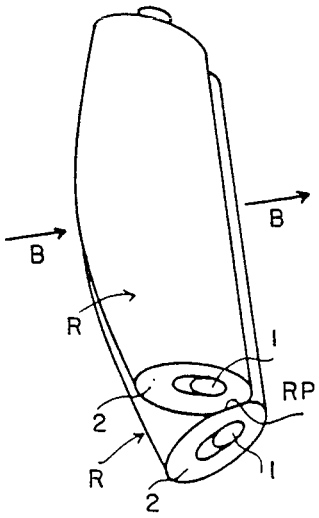
Figure 7F:
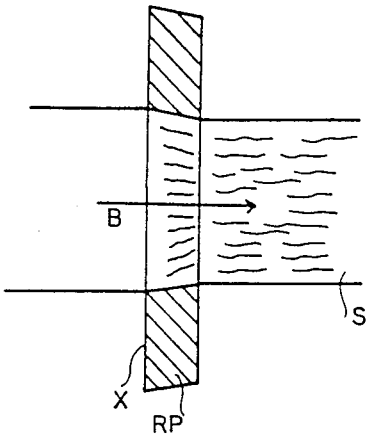

FIG. 7E shows a state in which the sheeting is subjected to inward forces, thereby allowing the sheeting to shrink as shown in FIG. 7F. Advantageously the intensified inward forces are applied to the sheeting.

When necessary the roller can be covered with a soft material, such as cloth or sponge.

What is claimed is:

1. A roller for feeding articles comprising an arched support shaft disposed in a fixed position under a no-load condition, and a roller surface layer mounted to rotate around said arched support shaft without the rotation of said shaft, said roller surface layer having a circumference which decreases progressively from its central portion to the ends thereof with said roller surface layer deforming with cyclical expansion and contraction in the direction of its width while being rotated about said arched support shaft such that at least one axial straight line is defined along an external periphery of said roller surface layer.

2. The roller as defined in claim 1, wherein said arched support shaft is arranged to be concave, and said circumference of said roller surface layer is shaped such that at least one axial straight line is defined along an uppermost portion of said surface layer.

3. The roller as defined in claim 1, wherein said arched support shaft is arranged to be concave, and said circumference of said roller surface layer is shaped such that an uppermost, uppermost portion of said surface layer axially forms a slightly concave curve and a pair of said at least one axial straight lines are defined adjacent thereto.

4. The roller as defined in claim 1, wherein said arched support shaft is arranged to be concave, and said circumference of said roller surface layer is shaped such that an uppermost portion of said surface layer axially forms a convex curve.

5. The roller as defined in claim 1, wherein the surface layer is made of elastic material.

6. The roller as defined in claim 5, wherein said surface layer is made of a material selected from the group consisting of rubber, soft metal, and soft ceramic.

7. The roller as defined in claim 1, wherein said roller surface layer comprises a bellows-shaped cylinder.

8. The roller as defined in claim 1, wherein said roller surface layer comprises a cylinder having spiral grooves formed therein.

9. The roller as defined in claim 1, wherein said roller surface layer is configured for applying forces to sheeting material passing thereover such that the sheeting material width in the axial direction of the roller assembly is enlarged.

10. A roller assembly for processing sheet material which is passed thereover, comprising:

an arched roller support shaft supported at opposite axial end positions and exhibiting a predetermined arched shape intermediate said end portion under no load conditions, and a roller surface layer mounted rotatably on the arched roller support shaft with the support shaft being rotatably fixed, said roller surface layer exhibiting an outer diameter which varies along its length, wherein said roller surface layer exhibits an outer diameter which progressively diminishes from its central portion towards respective opposite ends thereof.

11. A roller assembly according to claim 10, wherein the outer surface of the roller surface layer exhibits a straight peripheral side and a convex peripheral side at respective opposite sides of the axis thereof when in an operative position rotatably moveable about the arched roller support shaft.

12. A roller assembly according to claim 10, wherein the outer surface of the roller surface layer exhibits a concave peripheral side and a convex peripheral side at respective opposite sides of the axis thereof when in an operative position rotatably moveable about the arched roller support shaft.

13. A roller assembly according to claim 10, wherein the outer surface of the roller surface layer exhibits convex peripheral sides at respective opposite sides of the axis thereof when in an operative position rotatably moveable about the arched roller support shaft.

14. A roller assembly according to claim 10, wherein the surface layer is made of a soft elastic material.

15. A roller assembly according to claim 14, wherein said surface layer is made of rubber.

16. A roller assembly according to claim 10, wherein the surface layer is made of one of metallic and ceramic material.

17. A roller assembly according to claim 10, wherein the roller surface layer comprises a cylindrical member having bellow like grooves therein.

18. A roller assembly according to claim 10, wherein the roller surface layer comprises a cylindrical member having symmetrically configured spiral gaps therein.

19. A roller assembly according to claim 10, comprising a pair of said roller support shafts, with said roller surface layers mounted thereon, and further comprising mounting and driving means for disposing the pair of rollers adjacent one another for processing sheet material therebetween.

20. A roller assembly according to claim 19, further comprising mounting means for the ends of the respective roller support shafts to accommodate respective angular adjustment of the otherwise relatively fixed roller support shafts, to thereby adjust the effective shape of the outer surfaces of the rollers which is engageable against the sheeting material passed thereover.

21. A roller assembly for processing sheet material which is passed thereover, comprising:

an arched roller support shaft supported at opposite axial end positions and exhibiting a predetermined arched shape intermediate said end portion under no load conditions, and a roller surface layer mounted rotatably on the arched roller support shaft with the support shaft being rotatably fixed, said roller surface layer exhibiting an outer diameter which varies along its length, wherein said roller surface layer is configured for applying forces to heating material passing thereover such that sheeting material width in the axial direction of the roller assembly is reduced.

* * * * *